United States Patent [19]

Reid

[11] 4,074,508

[45] Feb. 21, 1978

[54] APPARATUS FOR COMPRESSING AND BANDING A PREDETERMINED NUMBER OF ARTICLES

[75] Inventor: Philip Lane Reid, Duncan, S.C.

[73] Assignee: Riegel Textile Corporation, New York, N.Y.

[21] Appl. No.: 752,906

[22] Filed: Dec. 21, 1976

[51] Int. Cl.[2] ..... B65B 57/14; B65B 13/04; B65B 13/20; B65B 13/32

[52] U.S. Cl. ..... 53/62; 53/124 C; 53/159; 53/198 R; 53/389; 83/171; 219/243; 242/75.43

[58] Field of Search ..... 53/124 C, 124 D, 124 CC, 53/198 R, 61, 59, 62, 228, 389, 159; 219/243, 512; 83/171; 242/75.43, 156, 156.2

[56] References Cited

U.S. PATENT DOCUMENTS

| | | | |
|---|---|---|---|
| 2,869,298 | 1/1959 | Zwoyer | 53/389 X |
| 2,955,398 | 10/1960 | Dreeben | 53/389 X |
| 3,000,151 | 9/1961 | Winkler et al. | 53/159 X |
| 3,069,107 | 12/1962 | Hirt | 242/75.43 |
| 3,131,278 | 4/1964 | Rosenthal | 83/171 X |
| 3,222,008 | 12/1965 | Purzycki | 242/75.43 |
| 3,416,286 | 12/1968 | Ciccone | 53/198 R |
| 3,435,584 | 4/1969 | Prechter | 53/159 X |
| 3,580,786 | 5/1971 | Doane et al. | 53/198 R |
| 3,648,431 | 3/1972 | Hartbauer et al. | 53/124 C |
| 3,720,040 | 3/1973 | Rocker | 53/159 X |
| 3,810,344 | 5/1974 | Evans et al. | 53/124 D |
| 3,921,928 | 11/1975 | Henry | 242/75.43 |
| 3,956,873 | 5/1976 | Kiener et al. | 53/198 R |

*Primary Examiner*—Othell M. Simpson
*Assistant Examiner*—Horace M. Culver
*Attorney, Agent, or Firm*—Bell, Seltzer, Park & Gibson

[57] ABSTRACT

Apparatus for compressing and banding a predetermined number of generally flat, compressible articles, such as disposable diapers, includes the following. Devices are positioned at one end of the apparatus for successively receiving the articles and for positioning the articles in a longitudinally extending row. Devices are provided for moving a group of a predetermined number of the articles from the receiving and positioning devices in a generally longitudinal path of travel to the other end of the apparatus and for compressing the articles at the other end of the apparatus. Devices position banding material across the path of travel of the group of articles for allowing the banding material to position itself around the leading end and sides of the group of articles as the group is moved to the other end of the apparatus. Devices then move the banding material around the trailing end of the group of compressed articles. Devices seal the banding material together in encircling relationship around the compressed group of articles. Control devices are provided for sequentially controlling and operating the above devices for the compressing and banding operation by the apparatus. Preferably, ejector devices are provided for ejecting a compressed and banded group of articles from the apparatus.

30 Claims, 16 Drawing Figures

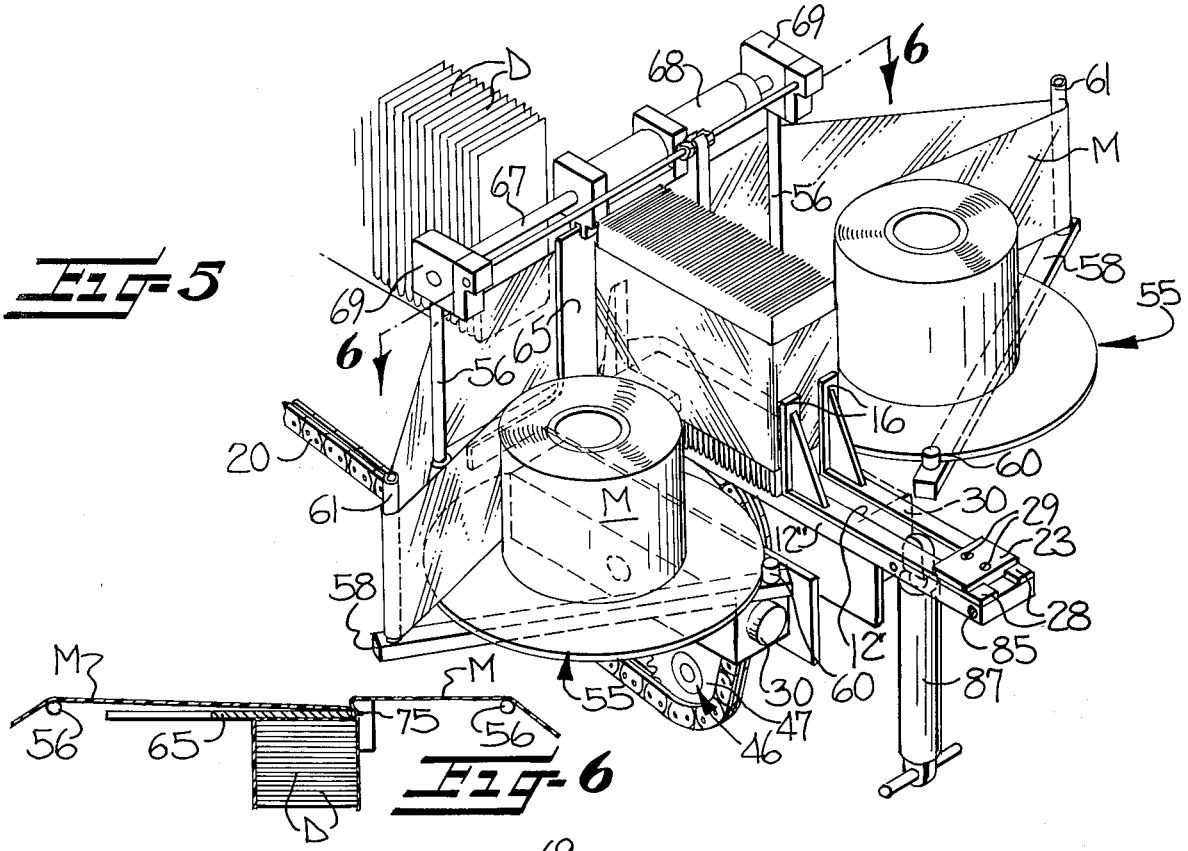
Fig-5
Fig-6
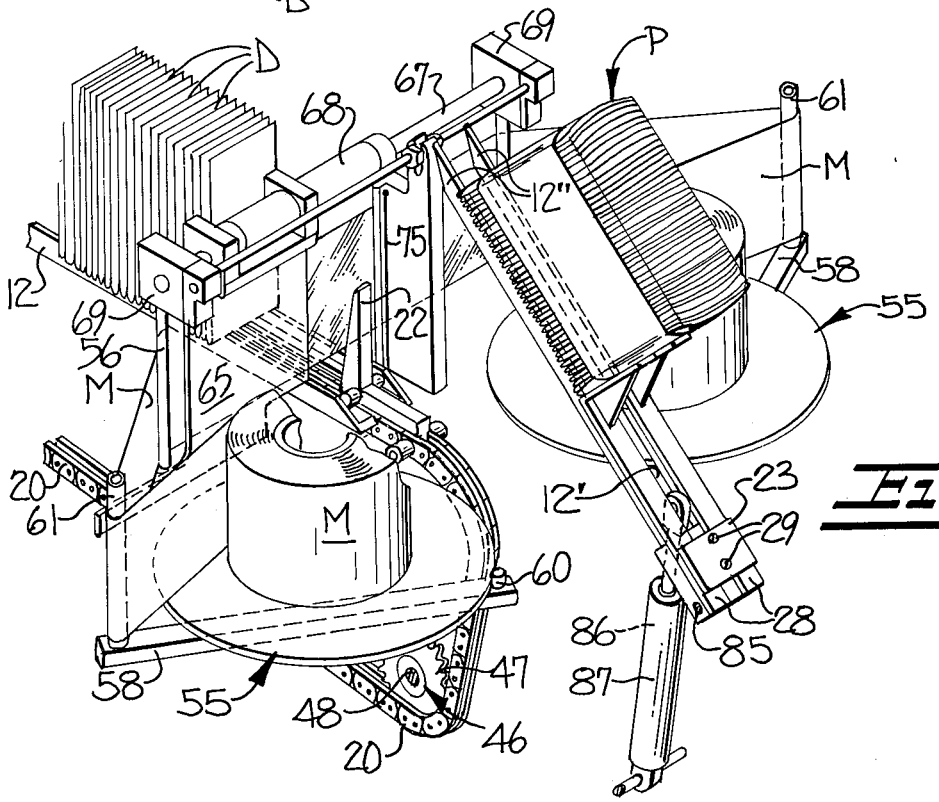
Fig-7

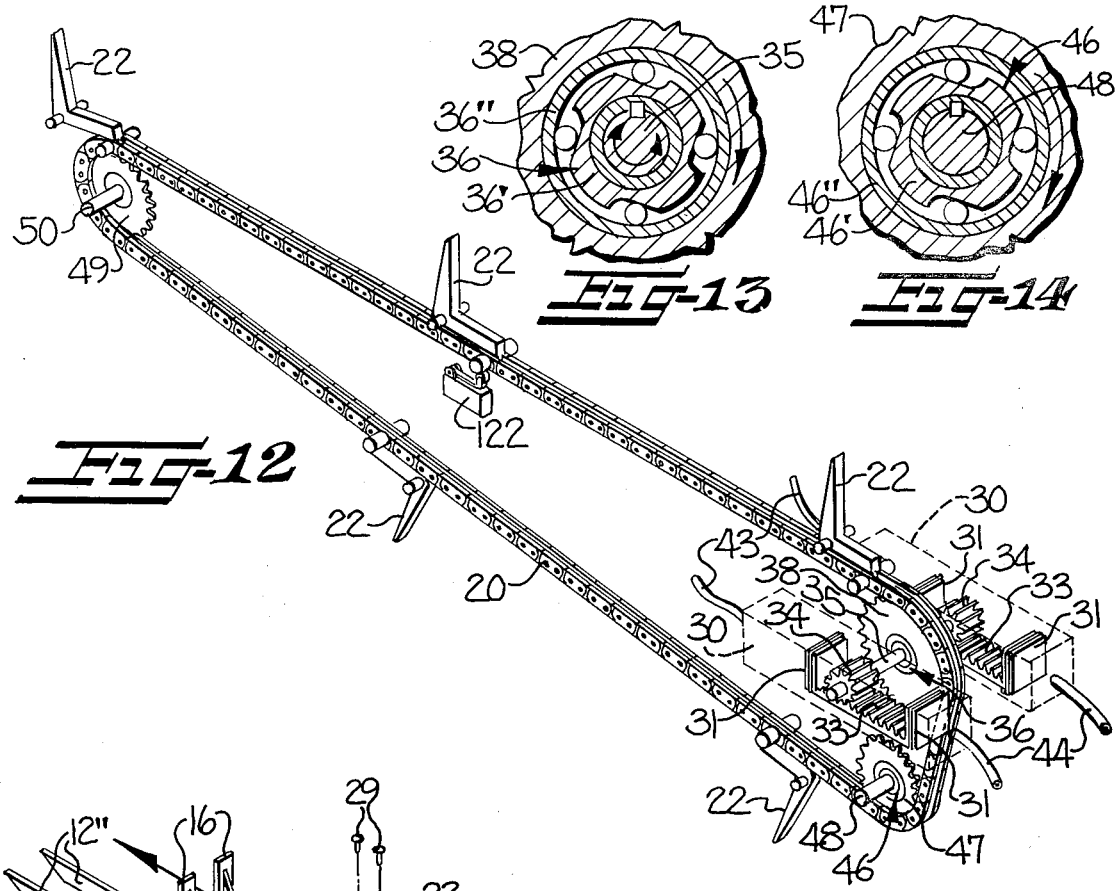
Fig-12
Fig-13
Fig-14
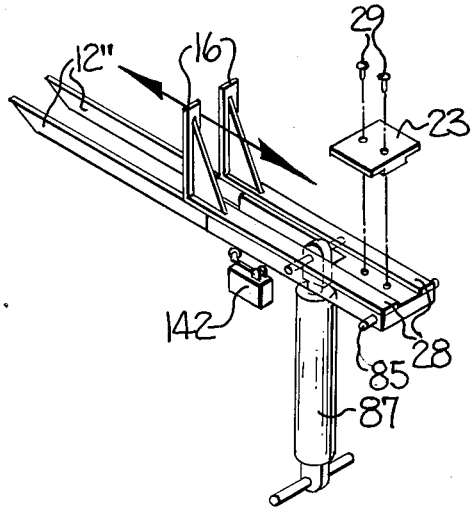
Fig-15
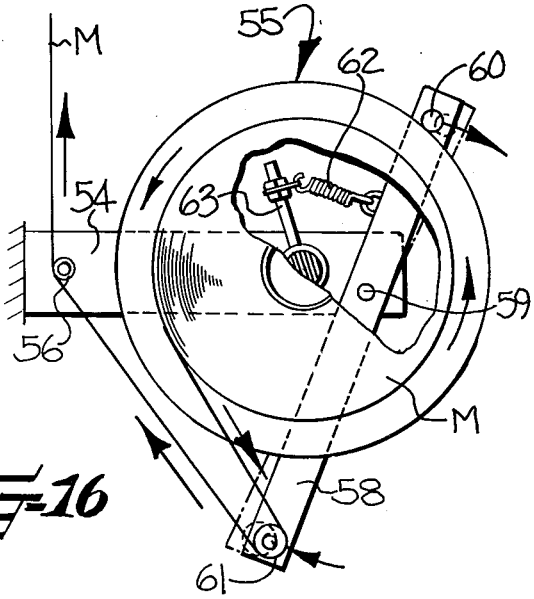
Fig-16

APPARATUS FOR COMPRESSING AND BANDING A PREDETERMINED NUMBER OF ARTICLES

This invention relates to an apparatus for compressing and banding a predetermined number of generally flat, compressible articles, such as disposable diapers.

BACKGROUND OF THE INVENTION

In the packaging of many generally flat compressible articles, particularly disposable diapers, these articles are divided into groups of predetermined numbers of such articles and packaged loosely in polybags or the like. This has presented a problem in shipping and in storage both in warehouses and on the retailers shelves inasmuch as the loosely packed articles often lack specifically defined shapes and, because of their compressible nature, utilized more storage space both on shelves in the retail outlets and warehouses and in the shipping thereof than was absolutely necessary for the relatively light weight of such articles.

Accordingly, it has been proposed to compress and band flat flexible articles, such as disposable diapers, and then package one or more banded and compressed groups in a polybag or the like for storage, shipping and retailing thereof. These compressed and banded groups of articles overcame the above-mentioned problems.

While some apparatuses have been suggested for compressing and banding groups of predetermined numbers of flat compressible articles, such apparatuses have suffered from many drawbacks in design and operation and, no commercially acceptable apparatus for compressing and banding disposable diapers is currently on the market.

KNOWN PRIOR ART

The following prior art patents were considered with respect to the present invention and are considered illustrative of the state of the art:

| U.S. Pat. No. | Inventor | Issue Date |
|---|---|---|
| 2,037,211 | Campbell | April 14, 1936 |
| 2,374,147 | Weeks | April 17, 1945 |
| 2,741,885 | Allison | April 17, 1956 |
| 2,768,489 | Brown, Jr. et al | Oct. 30, 1956 |
| 2,933,314 | Stobb | April 19, 1960 |
| 3,057,134 | Lallemand et al | Oct. 9, 1962 |
| 3,270,484 | Sorensen | Sept. 6, 1966 |
| 3,407,562 | Nicola | Oct. 29, 1968 |
| 3,513,628 | Lee et al | May 26, 1970 |
| 3,559,367 | Misik | Feb. 2, 1971 |
| 3,568,591 | Dunlap | March 9, 1971 |
| 3,618,740 | Taverna | Nov. 9, 1971 |
| 3,648,431 | Hartbauer et al | March 14, 1972 |
| 3,766,708 | Kubo et al | Oct. 23, 1973 |
| 3,798,871 | Purdom et al | March 26, 1974 |
| 3,810,344 | Evans et al | May 14, 1974 |
| 3,893,386 | Wise | July 8, 1975 |

OBJECTS AND SUMMARY OF INVENTION

It is the object of the present invention to provide an improved and commercially acceptable apparatus for compressing and banding a predetermined number of generally flat, compressible articles, such as disposable diapers, which overcomes problems presented by prior apparatus.

In accordance with this invention, the above object has been accomplished by providing an apparatus for compressing and banding a predetermined number of generally flat, compressible articles, such as disposable diapers, comprising the following.

Means are positioned generally at one end of the apparatus for successively receiving the articles and for positioning the articles successively in a longitudinally extending row. Means are provided for moving a group of a predetermined number of the articles from the receiving and positioning means in a generally longitudinal path of travel to generally the other end of the apparatus and for longitudinally compressing the group of articles at the other end of the apparatus.

Means are provided for positioning the banding material across the path of travel of the group of articles for allowing the banding material to position itself around the leading end and sides of the group of articles as the group is moved to the other end of the apparatus. Means are provided for moving the banding material around the trailing end of the group of compressed articles positioned at the other end of the apparatus. Means are provided for sealing the banding material together in encircling relation around the compressed group of articles.

Control means are operatively connected to the article moving and compressing means, the banding material moving means and the banding material sealing means for sequentially controlling and operating these means for the compressing and banding operation by the apparatus.

Preferably, an ejector means is operatively connected with the control means for being sequentially operated thereby for ejecting a compressed and banded group of articles from the apparatus after completion of the compressing and banding operations.

The means for successively receiving the articles for positioning the articles successively in a longitudinally extending row preferably comprises an elongate, longitudinally extending chamber having a bottom portion defining longitudinally extending slot means therein, side portions and an open top. The chamber is dimensioned for snuggly receiving the article through the open top in generally vertically and transversely extending positions and for holding the articles therein in such position. Pusher means may be provided for successively, longitudinally advancing the articles after being received in the chamber for providing space for receiving the next successive article and aiding in positioning the articles in a longitudinally extending row.

The article moving and compressing means preferably comprises longitudinally extending endless chain means having the upper flight thereof positioned adjacent and below the longitudinally extending row of articles and extending from the one end to the other end of the apparatus. Drive means are connected with the endless chain means for rotating same in a forward direction and are operatively connected with the control means for operation thereby. A plurality of finger means is carried by and extends outwardly from the endless chain means in predetermined, spaced relationship for contact with the articles, through the slot means in the bottom portion of the chamber means. Stop block means are positioned at generally the other end of the apparatus in the path of travel of the articles. With the above arrangement, the control means may selectively operate the endless chain drive means for rotating the endless chain means in a forward direction for positioning the finger means in contact with the rear of the longitudinally extending row of a predetermined number of articles received in the receiving and positioning means for moving the group of articles to the other end of the apparatus into engagement with the stop block means and for cooperating therewith to longitudinally compress the group of articles.

The means for positioning banding material across the path of travel of the group of articles preferably includes turntable means rotatably mounted on each longitudinal side of the path of travel of the group of articles from the one end to the other end of the apparatus for carrying respective supply rolls of banding material joined together and extending therefrom across the path of travel of the group of articles. The turntable means rotate to unwind the banding material when the group of articles is longitudinally moved into contact with the banding material and moved forwardly of the turntable means for allowing the banding material to position itself around the leading end and sides of the group of articles when the group is moved forwardly thereof to the other end of the apparatus. Preferably, brake means are operatively connected with the turntable means for stopping rotation of the turntable means when movement of the group of articles has stopped to prevent excessive unwinding of the banding material.

The means for moving the banding material around the trailing end of the group of compressed articles preferably comprises pusher plate means movably mounted adjacent and slightly forwardly of the banding material extending across the path of travel of the group of articles for movement into engagement with the banding material extending along one side of the group of articles and across the path of travel of the group of articles for carrying the banding material therewith to position the banding material around the trailing end of the compressed group of articles. Drive means are connected with the pusher plate means for reciprocating movement thereof and are operatively connected with the control means for operation thereby.

The banding material utilized in the apparatus of this invention preferably comprises heat sealable material. The means for sealing the banding material together in encircling relation around the compressed group of articles preferably comprises hot wire means positioned in cooperative relationship to the means for positioning the banding material around the trailing end of the compressed articles for being contacted by the banding material positioned around the leading end and sides of the compressed group of articles and the banding material positioned around the trailing end of the compressed group of articles for heat sealing the banding material together around the compressed group of articles, severing such banding material from the banding material extending across the path of travel of the articles and heat sealing together the thus formed ends of the banding material extending across the path of travel of the articles. Temperature limited heating means are connected with the hot wire means and with the control means for selectively heating the hot wire under control of the control means and includes means for stopping operation of the heating means when the hot wire reaches a predetermined temperature.

The control means of the apparatus of this invention preferably comprises a source of electrical energy and an electrical circuit means respectively connected between said source of electrical energy and the article moving and compressing means, the banding material moving means and the banding material sealing means for selectively supplying electrical energy therebetween for sequentially operating same.

The control means may further include automatic operating means including means connected in the electrical circuit means and with the article compressing and moving means for sensing and counting the articles as they are successively received by the receiving and positioning means for operating the article moving and compressing means after sensing and counting a predetermined number of articles. The automatic operating means may further include a first limit switch means connected in the electrical circuit means for being actuated upon the positioning of the group of articles at the other end of the apparatus for compression thereof. The automatic operating means further includes timing switch means connected in the electrical circuit means for being initially actuated by the first limit switch means upon its actuation for automatically and sequentially operating the banding material moving means and the banding material sealing means for the banding operation and for preparing the article moving and compressing means, the banding material moving means and the banding material sealing means for the next article compressing operation. The timing switch means may preferably comprise a timing motor connected in the electrical circuit means and with the first switch means for being initially actuated thereby, a plurality of timing cams connected with and driven by the timing motor, and cam switches connected in the electrical circuit means and associated with the timing cams for being operated thereby.

The control means may further include manually operating means including separate manually operated switches connected in the electrical circuit for being opened and closed for manually controlling operation of the article moving and compressing means, the banding material moving means, and the banding material sealing means.

The control means of this invention may include both the automatic operating means and the manual operating means or one or the other. If both are utilized in the control means, such control means would preferably further include a manually actuated selecting switch means connected in the electrical circuit for being operated to render the automatic operating means inactive when manual operation of the apparatus is desired and for being operated to activate the automatic operating means when automatic operation of the apparatus is desired.

BRIEF DESCRIPTION OF THE DRAWINGS

Some of the objects, advantages and broad description of this invention having been set forth above, other objects and advantages will become apparent with the following more detailed description of a preferred embodiment of this invention, when taken in conjunction with the accompanying drawings, in which:

FIG. 5 is a view, like FIGS. 3 and 4, illustrating the components of the apparatus in their respective positions at the completion of the banding operation;

FIG. 6 is a sectional view, taken generally along the line 6—6 of FIG. 5 and particularly illustrating the banding material being sealed together around the compressed group of articles;

FIG. 7 is a view, like FIGS. 3-5, illustrating the components of the apparatus in the position thereof for ejecting a compressed and banded group of articles from the apparatus;

FIG. 12 is a perspective detail of the means for moving a group of the articles from the receiving and positioning means to generally the other end of the apparatus and for longitudinally compressing the group of articles at the other end;

FIG. 13 is a sectional view, taken generally along the line 13—13 of FIG. 11;

FIG. 14 is a sectional view, taken generally along the line 14—14 of FIG. 11;

FIG. 15 is a perspective detail, partially exploded, of the ejector means of the apparatus; and FIG. 16 is a top plan view, partially broken away, of one of the turntable means illustrating the construction and operation of the brake means utilized therewith.

DESCRIPTION OF PREFERRED EMBODIMENT

Figure 1:
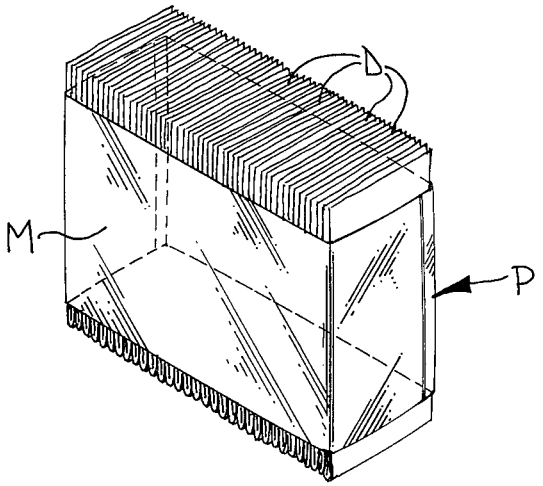
FIG. 1 is a perspective view of a compressed and banded group of articles produced by the apparatus of this invention.

Referring now to the drawings, a preferred embodiment of an apparatus, generally indicated at 10, is illustrated and will be described hereinafter for compressing and banding a predetermined number of generally, flat compressible articles, in the form of disposable diapers D, for forming a compressed and banded package P (see FIG. 1) of such articles. While the preferred form of apparatus 10 in accordance with this invention is illustrated in the drawings and will be described hereinafter in the form of an apparatus for compressing and banding disposable diapers D with a heat sealable material M, it is to be understood that the novel features of this invention are equally applicable to an apparatus for compressing and banding other generally flat, compressible articles, as will be apparent to those with ordinary skill in the art.

The compressing and banding apparatus 10 of this invention may be utilized, and indeed connected with the rear end of an apparatus for successively forming disposable diapers, such as illustrated in U.S. Pat. Re Nos. 28,139 and 3,984,272, both of which are assigned to the assignee of the present invention. Referring to each of these two patents for successively forming disposable diapers, it may be seen that each of these machines includes at the rear thereof an accumulator or the like means for accumulating and/or separating and counting disposable diapers formed therein for subsequent packaging and such devices include a "paddle shaped" pusher mechanism for reciprocating to successively move the diapers one at a time through a chamber or other suitable means for removal and packaging. This paddle shaped pusher means may be utilized with the apparatus 10 of this invention, as will be described below, for moving the disposable diapers forwardly in the apparatus 10 for successive receipt of the next disposable diaper D produced by the forming apparatus of these two patents. However, it is to be understood that the apparatus 10 of this invention could be utilized entirely separate from article forming machines, and the articles for compressing and banding by the apparatus 10 by this invention may be successively fed into the apparatus 10 by any suitable mechanism or manually.

The preferred form of apparatus 10 of this invention, as illustrated in the drawings, includes, firstly, means positioned generally at one end of the apparatus for successively receiving the articles or diapers D and for positioning the articles successively in a longitudinally extending row. This means preferably comprises an elongate longitudinally extending chamber having a bottom portion 12 defining a longitudinally extending slot 12' therein, side portions 14 and an open top, as may be seen particularly in FIG. 2. These side and bottom portions 12, 14 of the chamber are suitably mounted on and carried by stationary frame portions of the apparatus 10 in any suitable manner.

Figure 2:
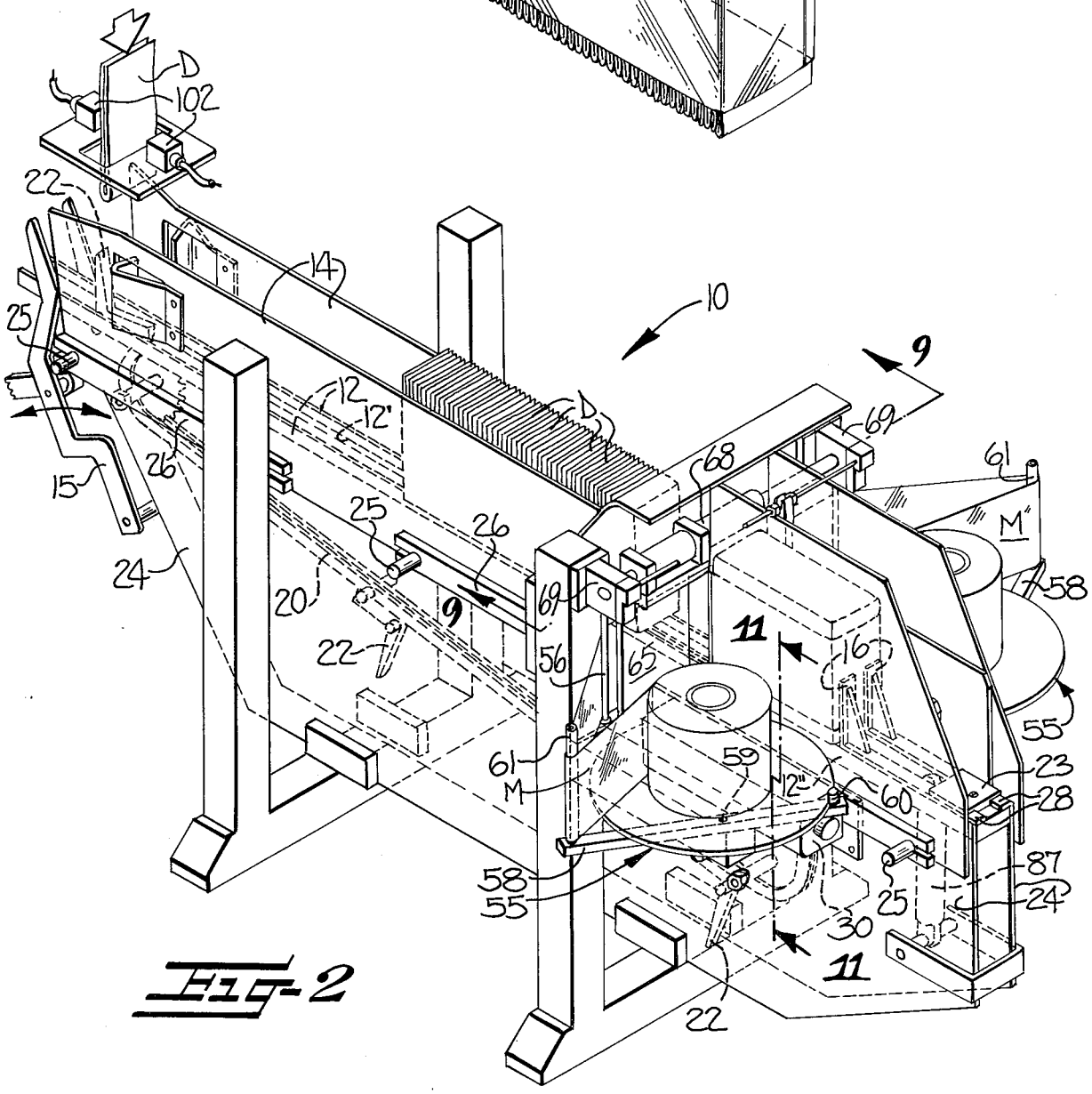
FIG. 2 is a perspective view of the compressing and banding apparatus of this invention.

This chamber is dimensioned for successively and snugly receiving the articles at one end thereof oriented in generally vertically and transversely extending positions, for allowing positioning of the articles at the one end thereof in a longitudinally extending row, and for allowing movement of the articles from the one end to the other end thereof for the compressing and banding operation while maintaining the generally vertical and transverse orientation of the article, as may be seen in FIG. 2..The side portions 14 define an opening therethrough for providing a transversely extending passageway across the chamber, as may be seen in the generally medial portion of FIG. 2, for receiving banding material M in a manner to be described below.

The articles or diapers D, as shown in FIG. 2, are successively fed, one at a time, into the chamber through the open top thereof and are pushed forwardly by reciprocating movement of the pusher device 15, which may form a part of the present machine or may form a part of the diaper forming apparatus to which the present apparatus 10 may be attached. The pusher device 15 may be driven by any suitable means for pushing the diapers D received in the above described chamber forwardly for receipt of the next successive diaper D.

The apparatus 10 further includes means for moving a group of a predetermined number of the articles or diapers D from the receiving and positioning location through the chamber in a generally longitudinal path of travel to generally the other end of the apparatus and the chamber and for longitudinally compressing the group of articles at the other end of the apparatus and the chamber. This means includes stop block means in the form of a pair of stop blocks 16 mounted on the bottom portion 12 of the chamber at generally the other end thereof in the path of travel of the diapers D for stopping movement of the diapers D from the one end of the chamber to the other end of the chamber.

This means further includes a longitudinally extending endless chain 20 having the upper flight thereof positioned adjacent and below the slot 12' in the bottom portion 12 of the chamber and extending generally from the one end of the chamber to the other end of the chamber. A plurality of compression fingers 22 are carried by and extend outwardly from the endless chain 20 in predetermined spaced relationship for extending through the slot 12' in the bottom portion 12 of the chamber for contact with the articles.

Figure 3:
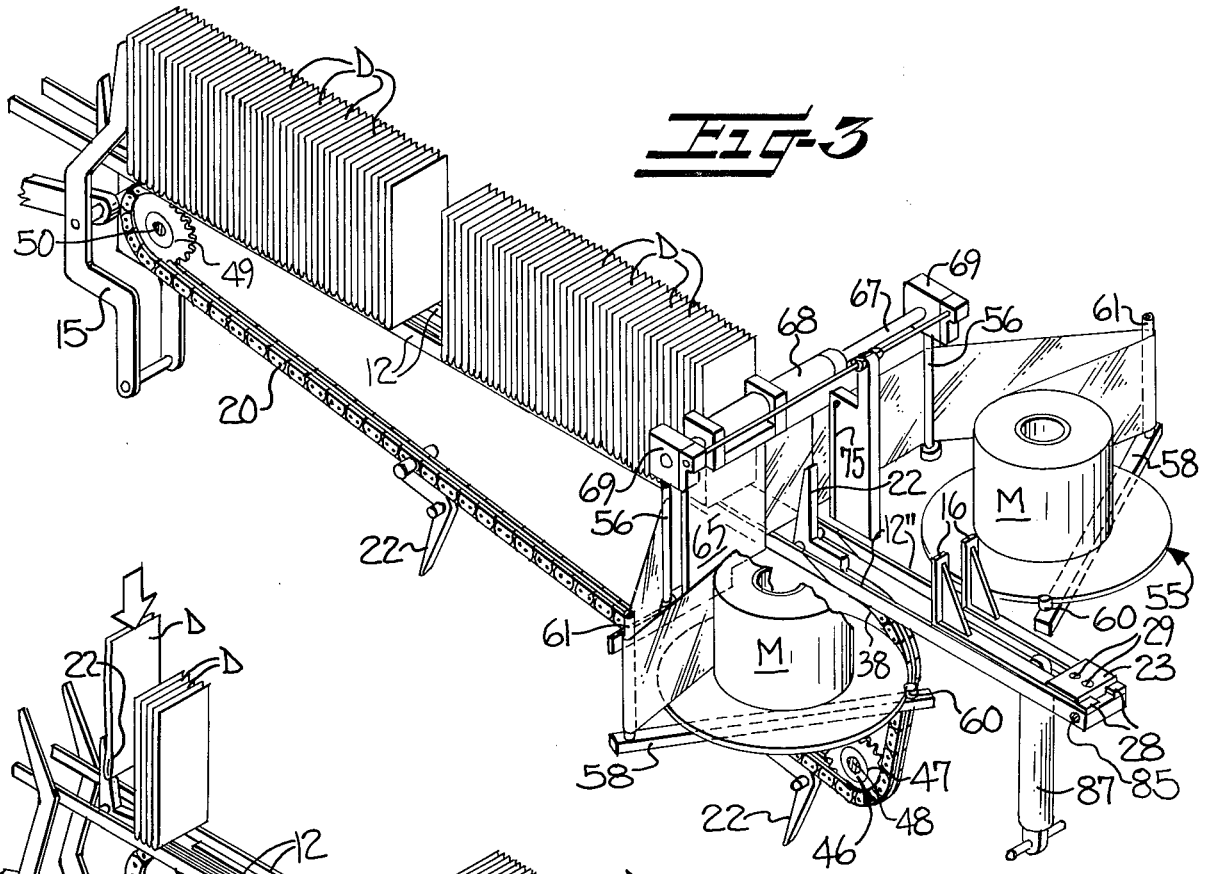
FIG. 3 is a schematic, perspective view, with certain parts omitted, of the compressing and banding apparatus illustrating the components thereof at the beginning of a cycle of operation for the start of the compressing operation.
Figure 4:
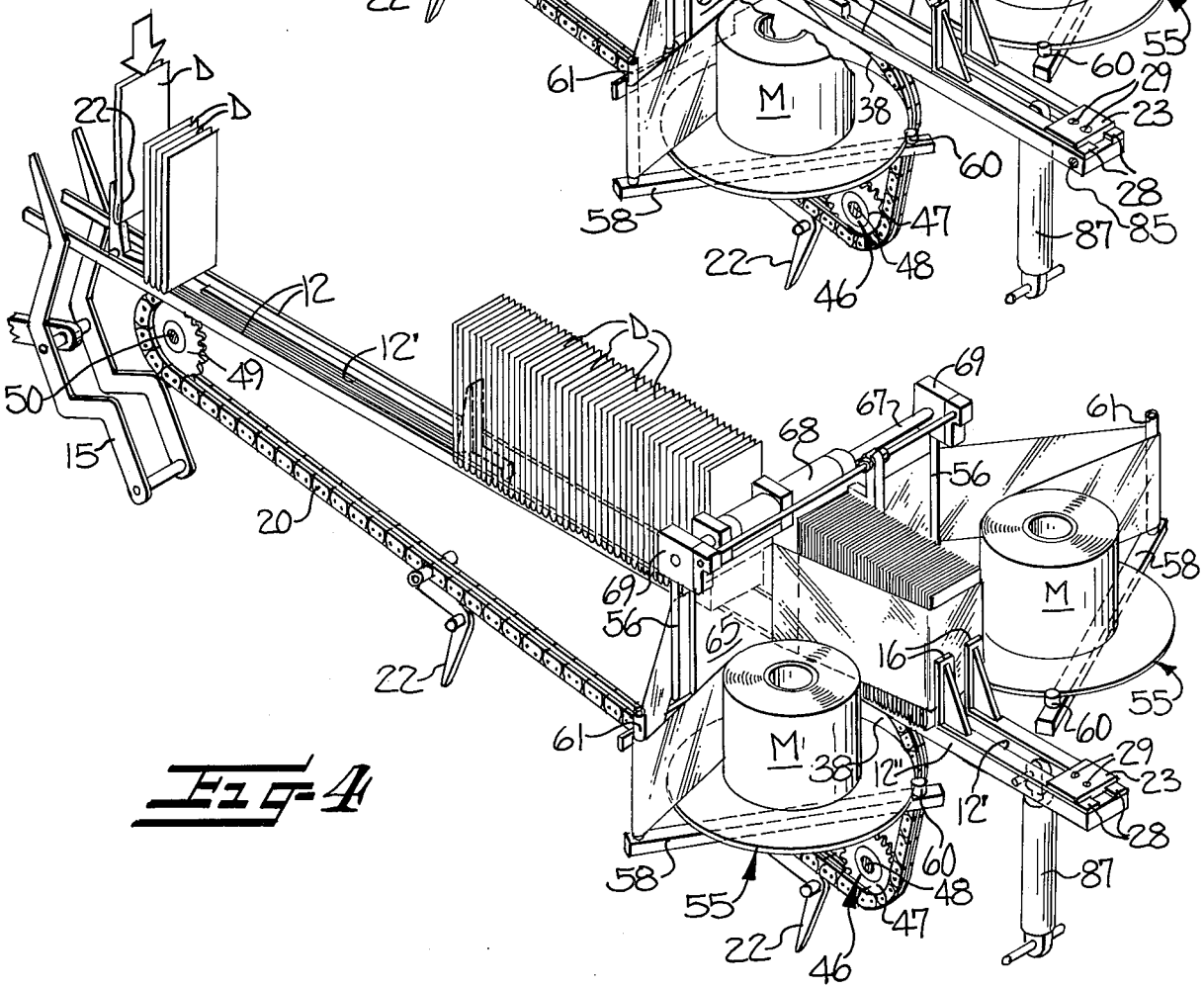
FIG. 4 is a view, like FIG. 3, illustrating the components of the apparatus in their respective positions after the compression operation has been completed and the banding operation has been started.

The chain 20 and compression fingers 22 are mounted for selective rotation of the chain 20 for positioning a respective one of the compression fingers 22 in contact with the rear of the longitudinally extending row of a predetermined number of disposable diapers D positioned within the chamber, as shown in FIG. 3, for moving the group of diapers to the other end of the chamber into engagement with the stop blocks 16 and for cooperating therewith to longitudinally compress the groups of articles, as shown in FIG. 4. The drive means and control means for selective driving of the chain 20 and compression fingers 22, will be described more specifically below.

Figure 10:
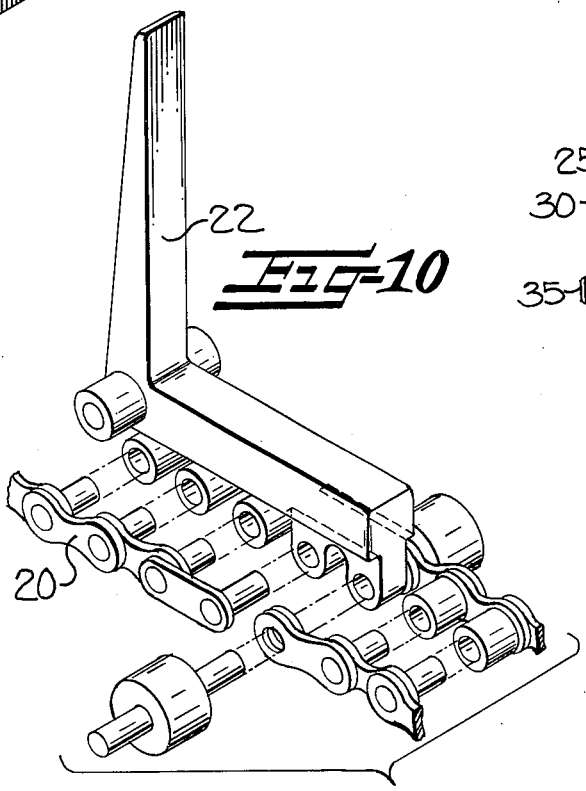
FIG. 10 is an exploded, perspective view of one of the compression fingers carried by the endless chain forming a part of the means for moving and compressing the group of articles.

The specific construction of the compression fingers 22 and the chain 20 may be seen in FIG. 10 and it is believed that this construction and mounting is self explanatory from this illustration. However, it is noted that the compression fingers are removably mounted so that a predetermined spacing therebetween may be obtained for varying the number of disposable diapers grouped thereby for compression by the apparatus 10 of this invention. Additionally, the sides 14 of the elongate chamber are adjustably mounted on side frame plates 24 of the apparatus 10, as shown particularly in FIGS. 2 and 11 by stub shafts 25 which are secured to the frame side plates 24 and include an adjustable collar 26 and bolts 27 which may be loosened for allowing transverse adjustment of the side plates 14 toward and away from each other along the stub shafts 25 for adjusting the dimensions of the chamber for accommodating various widths disposable diapers or other articles. Also, the stop blocks 16, as shown in FIG. 15, are mounted on plates 28 which are adapted to slide longitudinally forwardly and rearwardly by loosening of bolts 29 passing through stop plate 23 for obtaining longitudinal adjustment of the stop blocks 16 to accommodate varying groups of predetermined numbers of articles or diapers D for cooperative compression thereof with the compression fingers 22.

The endless chain 20 and compression fingers 22 are provided with a drive means for selective forward rotation thereof for the moving and compressing operation of a group of diapers D. This drive means comprises a pair of air actuators or double acting piston and cylinder means 30, 31 (see particularly FIG. 12) in which the piston 31 is constructed with two longitudinally spaced piston heads and a rack gear 33 extending therebetween as a conventional piston rod. The cylinder 30, as illustrated herein, is generally square in cross-sectional configuration and the piston heads are generally square. The rack gear 33 receives and meshes with a pinion gear 34 disposed within the cylinder 30 and secured to the end of a shaft 35 extending outwardly thereof and outwardly of the cylinder 30 and being keyed to the inner race 36' of a one-way clutch 36 which is of a conventional ball type having an outer race 36'' (see FIG. 13). The outer race 36'' of the one-way clutch 36 is secured to a drive sprocket 38 which is in meshing engagement with the endless chain 20 for supporting and driving the endless chain 20.

A fluid supply means in the form of a pressurized air supply 40 (see FIG. 8) supplies pressurized air through an air conduit 41 to a solenoid operated valve 42 which is selectively operated by the apparatus control means, to be described below, for providing a flow of air selectively through conduits 43 or 44 to respective opposite sides of the cylinders 30 so that when the solenoid valve is operated by the control means, pressurized air will flow through the conduit 43 to the forward ends of the cylinders 30 and move the pistons 31 rearwardly within the cylinder 30 to cause forward rotation of the pinion gear 34 by the rack gear 33 and thus forward rotation of the sprocket 38 through the one-way clutch 36. The balls of the one-way clutch 36 wedge between the inner race 36' and the outer race 36'' for driving engagement thereof during forward rotation of the pinion gear 34 to effect forward rotation of the sprocket 38. This will move the compression fingers 22 forwardly and thus move a group of diapers D from their receiving position within the chamber into a compression position (as shown in FIG. 4) in engagement with the stop blocks 16.

The solenoid valve 42 may then be reversed by the control means, to be described below, for supplying pressurized air through the conduit 44 to the other side of the cylinders 30 for causing a forward movement of the pistons 31 and thus a rearward rotation of the pinion gear 34 by the rack gear 33. This will cause a rearward rotation of the inner race 36' of the one-way clutch 36 which will cause the balls of the one-way clutch to move out of wedging engagement with the outer race 36'' and allow the pinion gear 34 and shaft 35 to rotate rearwardly relative to the sprocket 38 and thus allow these mechanisms to position themselves for the next reciprocating movement without causing rearward rotation of the chain 20 and compression fingers 22.

Figure 11:
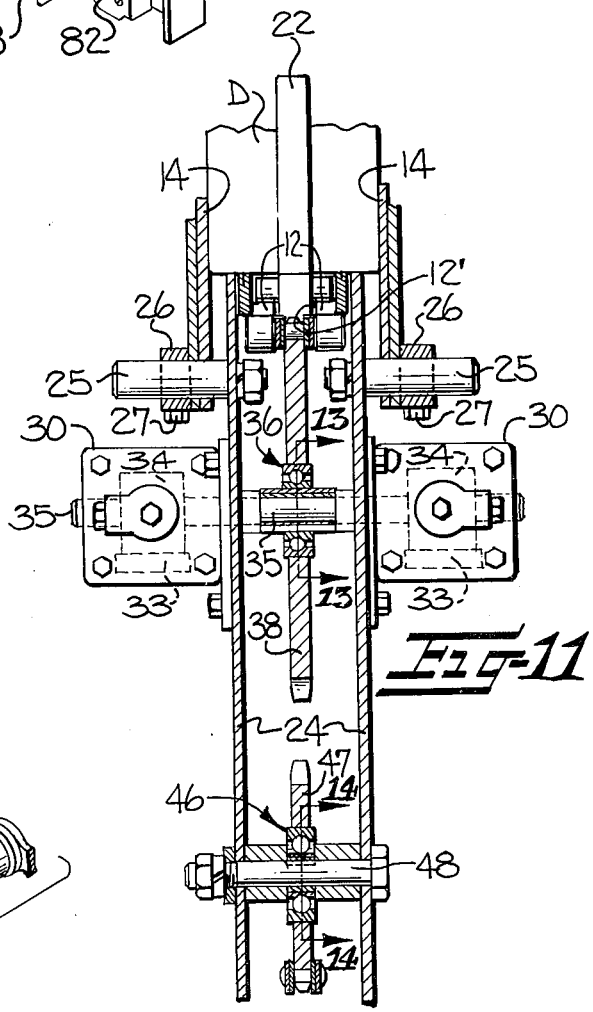
FIG. 11 is a sectional view, taken generally along the line 11—11 of FIG. 2.

The compression finger 22 will be held in compressive engagement with the group of diapers D being held between the respective compression finger 22 and the stop blocks 16 by a one-way brake 46 (see FIGS. 11, 12 and 14). The one-way brake 46 is a conventional ball type and is positioned between an idler sprocket 47 and a stub shaft 48 which is suitably secured to the machine frame against rotation. With this arrangement, the inner race 46' of the one-way brake 46 is keyed to the stationary stub shaft 48 and the outer race 46'' of the one-way brake 46 is secured to the idler sprocket 47 for rotation therewith. As may be seen particularly in FIG. 14, the idler sprocket 47 may rotate in a forward direction relative to the stationary stub shaft 48 during forward movement of the chain 20 and compression fingers 22. During rearward movement of the piston 31, rack gear 33 and pinion gear 34, the idler sprocket 47 and drive sprocket 38 will tend to also rotate rearwardly which would carry the chain 20 and compression fingers 22 rearwardly and loose the compression established on the group of diapers D by the compression finger 22 and stop block 16. However, this is prevented by the balls of the one-way brake 46 wedging between the inner race 46' and the outer race 46'' of the one-way brake 46 to prevent rearward rotation of the idler sprocket 47 and thus hold the compression established on the group of diapers D.

The endless chain 20 is further mounted on and carried by a second idler sprocket 49 mounted for rotation on a stub shaft 50 suitably secured to the machine frame.

Thus, drive means are provided for the endless chain and compression fingers 22 which form the means for moving a group of a predetermined number of diapers from the receiving position into the compression position which will selectively reciprocate the chain and compression fingers in a forward direction and reposition themselves for the next forward movement without losing the compression established on the group of a predetermined number of diapers D, through the use of a one-way clutch and one-way brake mechanisms. This drive means could utilize an electric motor in lieu of the above described pneumatic actuators, as will be understood by those with ordinary skill in the art.

The apparatus 10 further includes means for positioning banding material M across the path of travel of the group of articles or diapers D and for allowing the banding material M to position itself around the leading end and sides of the group of articles or diapers D as the group is moved to the other end of the apparatus 10 through the chamber by the moving and compressing means, i.e. the endless chain 20 and respective compression finger 22.

This means comprises turntable devices 55 suitably rotatably mounted on a portion apparatus frame 54 on each longitudinal side of the path of travel of the group of a predetermined number of diapers D and adjacent the transverse opening in the sides 14 of the elongate longitudinally extending chamber, as shown particularly in FIG. 2. These turntable devices 55 carry a respective supply roll of heat sealable banding material M being joined together and extending therefrom around guide rollers 56 and across the path of travel of the group of diapers D through the transverse opening in the side portions 14 of the elongate longitudinally extending chamber. The banding material M will unwind from the turntable devices 55 by rotation thereof when the group of diapers D is longitudinally moved into contact therewith and forwardly thereof by the compression finger 22 for allowing the banding material M to position itself around the leading end and sides of the group of diapers D, as shown in FIG. 4.

Each of the turntable devices 55 includes a brake means operatively connected with the turntable devices 55 for stopping rotation of the turntable devices when movement of the group of articles has stopped to prevent excessive unwinding of the banding material M from the supply rolls carried thereby. These brake means (see FIG. 16) each comprises a respective, elongate arm 58 pivotally mounted intermediate thereof at 59 on the portion 54 of the machine frame carrying the turntable device 55 and has each outer end thereof extending outwardly of the outside periphery of the turntable device 55. A friction brake means 60 is mounted on one end of the arm 58 and upstands therefrom for frictionally engaging the outer periphery of the turntable device 55. A guide roll 61 is mounted on and upstands from the other end of the arm 58 for receiving the banding material M therearound as the banding material extends from the supply roll carried by the turntable device 55 (as may be seen in FIG. 16). A biasing spring 62 is connected to the arm 58 and to a bracket 63 extending from the frame portion 54 of the machine for biasing the arm 58 in a direction for engagement of the brake device 60 with the outer periphery of the turntable device 55.

Accordingly, as the group of diapers D engages the banding material M extending across its path of travel from each of the turntable devices 55, a force will be exerted on the banding material M as the group of diapers D is moved forwardly which will pivot the arms 58 against the bias of springs 62 to disengage the brakes 60 from the outer periphery of the turntable devices 55 and allow the turntable devices 55 to rotate for unwinding of the material M. When the group of diapers has engaged and been compressed against the stop blocks 16, the force on the banding material M, which has now positioned itself around the leading end and sides of the group of diapers D, will be relaxed and the arms 58 will again pivot under the influence of the biasing springs 62 into a position for engagement of the brakes 60 with the outer periphery of the turntable devices 55 for stopping further rotation of the turntable device 55 and excessive unwinding of the banding material M therefrom.

The apparatus 10 further includes means for moving the banding material M around the trailing end of the group of compressed articles positioned at the other end of the apparatus and the chamber therein and being held in compressed position between the respective compression finger 22 and the stop blocks 16.

This means comprises a pusher plate 65 movably mounted adjacent and slightly forwardly of the turntable devices 55 for transverse movement from one side of the chamber, into engagement with the banding material extending longitudinally along one side of the group of articles, and across the path of travel of the group of articles through the chamber and through the transverse opening therein for carrying the banding material therewith to position the banding material around the trailing end of the compressed group of articles (see FIGS. 4, 5 and 6).

Figure 8:
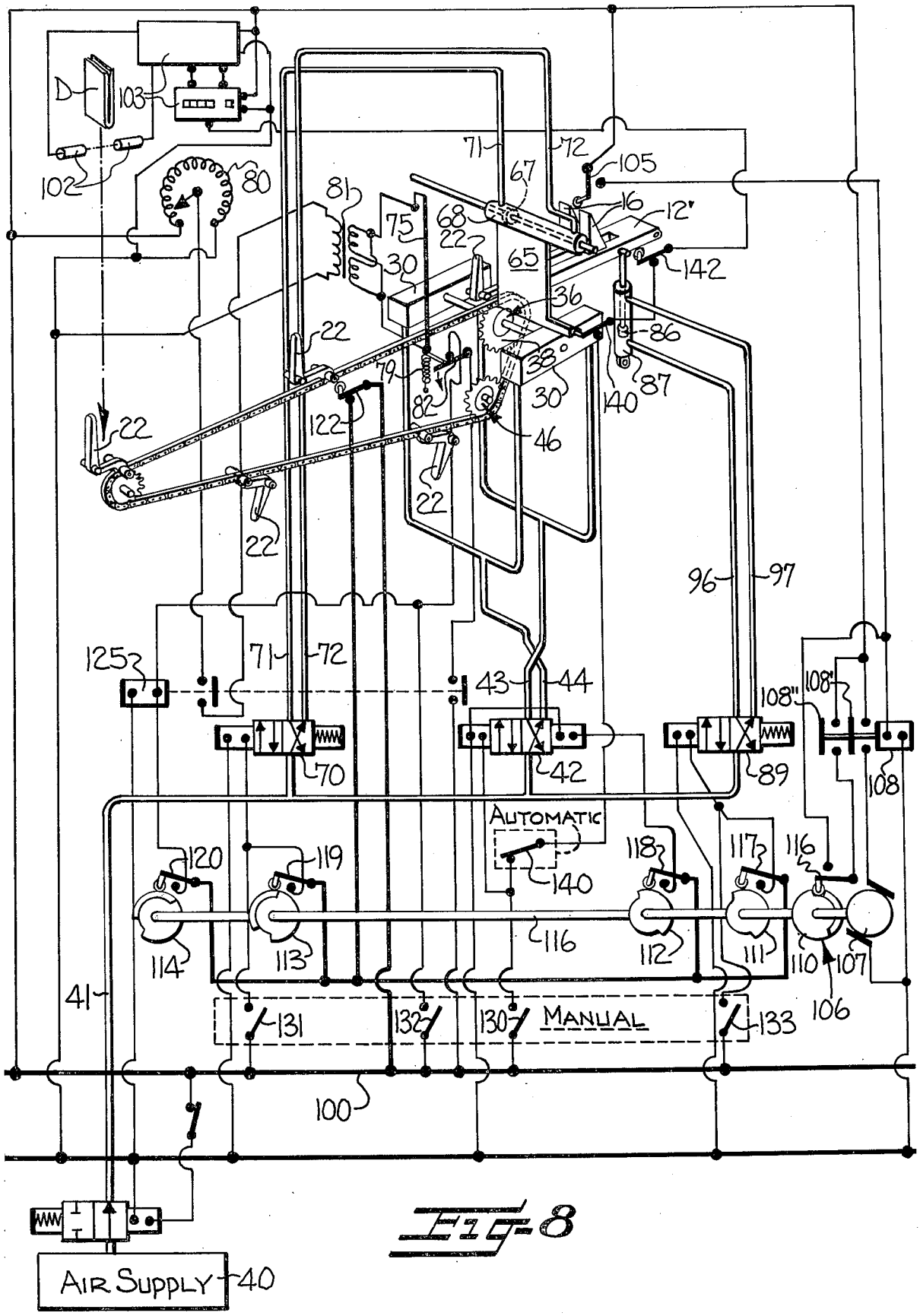
FIG. 8 is a schematic, electrical, mechanical and pneumatic diagram illustrating particularly the control mechanisms of the apparatus of this invention.
Figure 9:
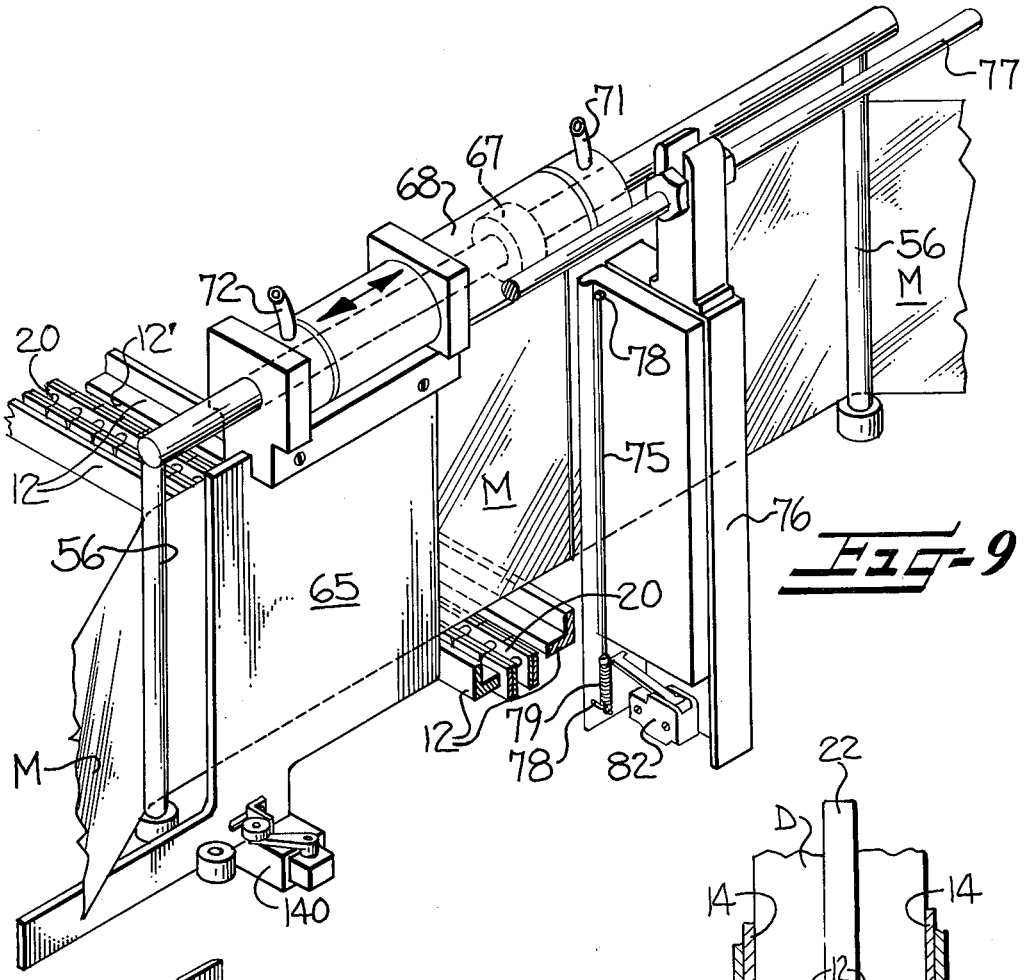
FIG. 9 is a sectional view, taken generally along the line 9—9 of FIG. 2, illustrating particularly the means for moving the banding material around the trailing end of the group of compressed articles and the means for sealing the banding material together around the compressed group of articles.

The pusher plate means includes drive means which is illustrated, particularly in FIG. 9, as a fluid operated piston and cylinder device 67, 68. The piston 67 is mounted stationary between upstanding portions 69 (see FIG. 2) of the machine frame and the cylinder 68 carries the pusher plate 65 in any suitable manner, for movement therewith such as the screw and bracket arrangement illustrated in FIG. 9. The drive means further includes a source of fluid, such as the source of pressurized air 40 illustrated in FIG. 8, which supplies pressurized air through the air conduit 41 to a solenoid operated valve 70 which is selectively operated by the apparatus control means, to be described below, for providing a flow of air selectively through conduits 71 or 72 to respective opposite sides of the cylinder 68. With this arrangement, when the solenoid valve 70 is operated by the control means, pressurized air will flow through the conduit 71 to one end of the cylinder 68 and move the cylinder 68 relative to the piston 67 forwardly for carrying the pusher plate across the path of travel of the group of diapers D to carry the banding material M around the trailing end of the compressed group of diapers D. The control means may then operate the solenoid valve 70 to cause a flow of pressurized air through the conduit 72 to the other side of the cylinder 68 for moving the cylinder 68 and pusher plate 65 relative to the piston 67 for a return movement for the next operation.

The apparatus 10 next includes means for sealing the banding material M together in encircling relation around the compressed group of articles when the pusher plate device 65 has positioned the banding material M around the trailing end of the group of diapers D to complete the encircling relationship thereof around the compressed group of diapers D.

This means comprises a hot wire 75 (see particularly FIGS. 6, 8 and 9) positioned in cooperative relation with the pusher plate 65 for being contacted by the heat sealable banding material M as the pusher plate 65 moves the banding material M around the trailing end of the compressed group of articles for heat sealing the banding material M together around the compressed group of articles, severing such binding material M from that extending from the turntable devices 55, and heat sealing together the thus formed ends of the banding material M extending from the turntable devices 55. This sealing and severing operation may be seen particularly in FIG. 6 wherein it is shown that the hot wire 75 will sever the banding material M extending from each of the turntable devices 55, while severing the banding material M extending around the compressed group of diapers D, and heat seal together the ends of the banding material M extending from the supply rolls on each of the turntable devices 55 and the ends of the banding material M extend around the compressed group of diapers D.

The hot wire, 75, as may be seen particularly in FIG. 9, is suitably mounted in a stationary housing 76 which in turn mounted on a rod 77 extending from and carried by the upstanding portions 69 of the machine frame. The hot wire 75 is mounted between a pair of posts 78 and includes a spring 79 between the lower end thereof and the bottom post 78 for biasing the hot wire 75 in the downward direction.

The hot wire 75 is heated by a temperature limited heating means connected therewith and with the apparatus control means, to be described below, for selectively heating the hot wire 75 and for stopping heating thereof when the hot wire reaches a predetermined temperature.

This heating means, as shown in FIG. 8, comprises an electrical heating means utilizing a rheostat 80 and a transformer 81 for supplying energy through the hot wire 75 for heating of same. The electrical energy through the rheostat 80, transformer 81 and hot wire 75 passes through an electrical circuit forming part of the apparatus control means, to be described below.

The hot wire 75 preferably comprises a wire which stretches when heated to a predetermined temperature, such as nichrome. Accordingly, because of the bias on the nichrome hot wire 75 exerted by the spring 79, the hot wire 75 will stretch downwardly when it reaches a predetermined desired temperature by the electrical heating means. A switch 82 is connected with the hot wire 75 for being opened upon the stretching of the hot wire 75 to break the electrical circuit through the rheostat 80, transformer 81 and hot wire 75 to stop operation of the electrical heating means when the hot wire 75 reaches a predetermined temperature. Therefore, the hot wire mechanisms 75 is temperature limited, rather than time limited as are most of the prior hot wire devices, and, accordingly, performs the sealing operation on the banding material at the same temperature for each sealing operation unaffected by thermal hysteresis.

The apparatus 10 may further preferably include ejector means operatively connected with the apparatus control means, to be described below, for being sequentially operated thereby for ejecting a compressed and banded package P of articles from the apparatus 10 after completion of the compressing and banding operations.

As may be seen in FIGS. 2–8 and 15, this ejector means comprises the bottom portions 12' of the forward portion of the chamber carrying the stop blocks 16 and in the area in which the compression operation takes place. These bottom portions 12'' of the bottom of the chamber are detached from the remaining bottom portions 12 of the chamber and are pivotally mounted at 85 to suitable portions of the stationary apparatus frame for upward movement, as shown in FIG. 7, for ejecting a package P of compressed and banded diapers D after the compressing and banding operations.

Drive means are connected therewith for selective pivotal reciprocating movement thereof for the ejecting operation. This drive means is in the form of a fluid operated piston and cylinder 86, 87 in which the piston 86 is connected to the portions 12' and the cylinder 87 is suitably secured to a stationary frame portion. The drive means further includes a source of pressurized fluid, such as the air supply 40, which supplies air through conduit 41 to a solenoid operated valve 89 which is connected with and operated by the apparatus control means, to be described below. The solenoid operated valve 89 may be operated to allow the flow of pressurized air through a conduit 96 to the bottom of the cylinder 87 to move the piston 86 outwardly of the cylinder 87 to pivot the portions 12'' in an upward direction for the ejecting operation, as shown in FIG. 7. The solenoid valve 89 may then be selectively operated to allow the flow of air through a conduit 97 to the top of the cylinder 87 to return the piston 86 and the portions 12'' to their original positions for the next compressing and banding operation.

As has been indicated above, the apparatus 10 further includes control means, diagrammatically illustrated in FIG. 8, which is operatively connected to the drive for the endless chain 20 and compression fingers 22, the drive for the banding material pusher plate 65 and the heating means for the hot wire 75 for sequentially controlling and operating same for the compressing and banding operation.

The control means may include, as illustrated in FIG. 8, a source of electrical energy, generally indicated at 100, and an electrical circuit respectively connected between the source of electrical energy 100, the solenoid operated valve 42 constituting a part of the pneumatic drive means for the endless chain 20 and compression fingers 22, the solenoid operated valve 70 constituting part of the pneumatic drive means for the pusher plate 65, and the electrical heating means 80, 81, 82 for the hot wire 75 for selectively supplying electrical energy therebetween for sequentially operating same.

The control means may further include automatic operating means including means connected in the electrical circuit and with the drive means for the article compressing and moving means, i.e. the endless chain 20 and compression fingers 22, for sensing and counting the articles as they are successively received by the receiving and positioning means, i.e. the elongate chamber consisting of bottom portion 12 and side portions 14, for operating the article moving and compressing means after sensing and counting a predetermined number of articles.

This sensing and counting means, as illustrated diagrammatically in FIG. 8, comprises a suitable photoelectric cell device 102 through which the diapers D successively pass during the inserting thereof in the elongate chamber constituting the receiving and positioning means of the apparatus 10. The photoelectric cell device 102 may be conveniently positioned on a portion of the apparatus of assignee's prior U.S. Pat. Re. Nos. 28,139 and 3,984,272, which ejects diapers D successively therefrom after fabrication and folding of same, as indicated schematically in FIG. 2. Also, the photoelectric cell sensing device may be conveniently placed at any location with respect to the apparatus 10 for sensing diapers D as they are successively inserted into the elongate chamber forming the receiving means of the apparatus 10.

The sensing and counting means further includes an adjustable solid state predetermined counter 103 which may be of any suitable commercial construction, well known to those with ordinary skill in the art, for being pulsed by the photoelectric cell device 102 during the sensing of each successive disposable diaper D and for establishing a flow of electrical energy, at a preset number which has been counted thereby, through the electrical circuit means of the control means of the apparatus 10. It has been found convenient in the control means of the apparatus 10 of this invention to utilize a counter which can be preset at the numbers 18, 20, 24 and 30 since these are conventional groupings of predetermined numbers of disposable diapers D for compressing and banding. However, other predetermined numbers could be utilized.

The sensing and counting means 102, 103 is electrically connected, as shown in FIG. 8, through the electrical circuit means with the solenoid operated valve 42 of the drive means for the endless chain 20 and compression fingers 22 for actuating the valve means 42 upon the sensing and counting means 102, 103 sensing and counting a predetermined number of disposable diapers D being received in the apparatus, for operating the drive means for the endless chain 20 and compression fingers 22, described above.

The automatic operating means further includes a first limit switch 105 connected in the electrical circuit and positioned, as shown particularly in FIG. 8, for being actuated or closed upon the positioning of the group of diapers D at the other end of the chamber of the apparatus 10 in engagement with the stop blocks 16 for compression thereof.

The automatic operating means further includes timing switch means, broadly indicated at 106 connected in the electrical circuit for being initially actuated by the closing of the first limit switch 105 for automatically and sequentially operating the banding material moving means, i.e. the pusher plate 65, and the banding material sealing means, i.e. the hot wire 75, for the banding operation and for preparing the article moving and compressing means, i.e. the mechanical drive devices 31, 34, 35, the banding material moving means, i.e. the pusher plate 65 and cylinder 68, and the banding material sealing means, i.e. hot wire 75 and heating means 80, 81 and 82, etc., for the next article compressing and banding operation.

This timing switch means 106 preferably comprises a timing motor 107 connected in the electrical circuit and initially actuated by the actuation or closing of the limit switch 105 through a solenoid operated switch 108 upon the positioning of a group of a predetermined number of diapers D in the compression position against the stop blocks 16 by a compression finger 22. The timing switch means further includes a plurality of timing cams 110, 111, 112, 113, 114 which are all suitably mounted on a shaft 116 extending from and driven by the timing motor 107. The timing switch means further includes a respective switch 116, 117, 118, 119, 120 associated with each of the respective cams 110–114 for operation thereby, as may be seen in FIG. 8.

As may be seen, when the first limit switch 105 is closed by the positioning of a group of diapers D in the compression position, the solenoid switch 108 will be actuated for closing its contact sets 108' and 108'' for supplying electrical energy to the timing motor 107 to start its operation and rotation of the cams 110–114. Immediately upon this rotation of the cams 110–114, the cam 110 will operate to close the switch 116 which will provide a holding circuit with the switch 108 for the timing motor 107 through a complete cycle of rotation of each of the cams 110–114 even after opening of the switch 105.

Therefore, after the counting and sensing means 102, 103 has sensed and counted a predetermined number of diapers D being received in the apparatus 10 and the receiving chamber thereof, the solenoid valve 42 will be actuated by an electrical signal sent through the electrical circuit means by the counting device 103 to initiate a forward rotation of the chain 20, in the manner described above, to cause a compression finger 22 to engage the rear of a group of predetermined number of diapers D received in the elongate chamber and move this group forwardly into compressive position against the stop blocks 16. This will actuate the limit switch 105 and initiate operation of the timing motor 107 and rotation of the timing cams 110–114. Movement of the compression finger 22 on the endless chain 20 continues and one of the compression fingers engages a second limit switch 122 connected in the electrical circuit as a safety switch and with each of the cam operated switches 116–120 to establish the flow of electrical energy through the switches 116–120 when the switches are closed by the cams 110–114.

The cam operated switch 118 is connected with the other side of solenoid operated valve 42 forming part of the pneumatic drive means for the endless chain 20 and compressing finger 22 so that when the cam 112 has rotated sufficiently to allow the closing of switch 118, this switch will cause opposite actuation of the solenoid valve 42 for providing return movement of the mechanical portions of the endless chain and compression finger drive means, in the manner described above. At this time, the counter 103 has ceased the sending of an electrical signal to the solenoid valve 42 and is presently counting the next group of a predetermined number of diapers D being received by the apparatus 10.

The cam operated switch 119, operated by the cam 113, is electrically connected with the solenoid valve 70 forming part of the drive means for the banding material pusher plate 65 so that, at the appropriate time during the cycle of rotation of the timing cam 110–114 during the banding and compressing operation by the apparatus 10, the switch 119 will be closed for causing actuation of the solenoid valve 70 to effect a forward movement of the pusher plate 65 for moving the banding material M around the trailing end of the compressed group of diapers D. Almost simultaneously, the cam operated switch 120 will be closed by operation of the cam 114 to actuate a solenoid switch 125 which will complete the electrical circuit through the heating means 80, 81, 82 for the hot wire 75 so that the operation for completing the encircling of the banding material M around the compressed group of diapers and the sealing thereof may be effected.

After this operation, the cams 113 and 114 will again open the switches 119, 120 which will cause the solenoid valve 70 to reverse under the influence of the spring thereon, indicated schematically in FIG. 8, to reverse the pusher plate 65 to its original position and to stop operation of the heating means for the hot wire 75.

The last function of the timing switches is the closing of switch 117 by cam 111 to actuate solenoid valve 89 for operating the ejector means to eject the banded and compressed group of diapers D. When the switch 117 is thereafter opened by the cam 111 after the ejecting operation, the spring on the solenoid valve 89, indicated schematically in FIG. 8, will reverse the solenoid valve 89 to move the ejecting means back to its starting position.

Thus, a fully automatic control means for the article compressing and banding operation is provided for operating the apparatus 10.

The control means of the apparatus 10 may further include manual operating means including separate, manually operated, switches 130, 131, 132, 133, as shown in FIG. 8. These manually operated switches are respectively connected in the electrical circuit means between the source of electrical energy 100 and the article moving and compressing means i.e. solenoid valve 42 of the drive means for the endless chain 20 and compression fingers 22, the banding material moving means, i.e. the solenoid valve 70 for the drive means for the banding material pusher plate 65, the banding material sealing means, i.e. the electrical circuit for the heating means 80, 81, 82 for the hot wire 75, and the ejector means, i.e. the solenoid valve 89 for the drive means for the ejector means.

With this arrangement, the solenoid valve 42 of the drive means for the endless chain 20 and compression fingers 22 may be selectively manually operated by the manual switch 130. The solenoid valve 70 constituting part of the drive means for the banding material pusher plate 65 may be selectively manually operated by the switch 131. The heating means for the hot wire 75 may be selectively operated by the manually actuated switch 132. The solenoid valve 89 for the drive means for the ejector means may be selectively manually operated by the switch 133.

When the automatic operating means and the manual operating means are both used in the control means of the apparatus 10, as shown in FIG. 8, a manually actuated selecting switch 140 is preferably connected in the electrical circuit for being operated to render the automatic operating means inactive when manual operation of the apparatus is desired, and for being operated to activate the automatic operating means when automatic operation of the apparatus is desired.

The control means of the apparatus 10 may further include, in addition to the safety limit switch 122, further safety limit switches 140 and 142 which are connected in the electrical circuit from the sensing and counting means 102, 103 to the solenoid valve 42 which constitutes a part of the drive for the article moving and compressing means so that this solenoid valve 42 may not be actuated unless the pusher plate device 65 and the ejector means, respectively, are in their starting positions.

As will be appreciated by those with ordinary skill in the art, the control means of the apparatus 10 of this invention may utilize either the above described automatic operating means, or the above described manual operating means, or preferably both automatic and manual operating means.

Thus, it may be seen, that this invention has provided a compact, simply constructed, apparatus for receiving, grouping, compressing and banding a predetermined number of flat, compressible articles, such as disposable diapers D, which may be efficiently operated manually or automatically and which may be utilized alone or in conjunction with an automatic article fabricating machine.

In the drawings and specification there has been set forth a preferred embodiment of this invention, and although specific terms are employed, they are used in a generic and descriptive sense only and not for purposes of limitation.

What is claimed is:

1. Apparatus for compressing and banding a predetermined number of generally flat, compressible articles, such as disposable diapers, comprising:

means positioned generally at one end of said apparatus for successively receiving the articles and for positioning the articles successively in a longitudinally extending row;

means for moving a group of a predetermined number of the articles from said receiving and positioning means in a generally longitudinal path of travel to generally the other end of said apparatus and for longitudinally compressing the group of articles at the other end of said apparatus;

means for positioning banding material across the path of travel of the group of articles and for allowing the banding material to position itself around the leading end and sides of the group of articles as the group is moved to the other end of said apparatus;

means for moving the banding material around the trailing end of the group of compressed articles positioned at the other end of said apparatus;

means for sealing the banding material together in encircling relation around the compressed group of articles; and control means operatively connected to said article moving and compressing means, said band material moving means and said band material sealing means for sequentially controlling and operating these said means for the compressing and banding operation by said apparatus, said control means comprising a source of electrical energy, an electrical circuit means respectively connected between said source of electrical energy and said article moving and compressing means, said banding material moving means and said banding material sealing means for selectively supplying electrical energy therebetween for sequentially operating same, and separate manually operated switches connected in said electrical circuit means for being opened and closed for manually controlling operation of said article moving and compressing means, said banding material moving means and said banding material sealing means.

2. Apparatus, as set forth in claim 1 in which said means for successively receiving the articles and for positioning the articles successively in a longitudinally extending row comprises an elongate, longitudinally extending chamber having a bottom portion defining longitudinally extending slot means therein, side portions and an open top, said chamber being dimensioned for snugly receiving the articles through said open top in generally vertically and transversely extending positions and for holding the articles therein in such positions and pusher means for successively, longitudinally advancing the articles after being received in said chamber for providing space for receiving the next successive article and positioning the articles in a longitudinally extending row.

3. Apparatus, as set forth in claim 1, in which said article moving and compressing means comprises longitudinally extending endless chain means having the upper flight thereof positioned adjacent and below the longitudinally extending row of articles and extending from the one end to the other end of said apparatus, drive means connected with said endless chain means for rotating same in a forward direction and being operatively connected with said control means for operation thereby, a plurality of finger means carried by and extending outwardly from said endless chain means in predetermined, spaced relationship for contact with the articles, and stop block means positioned at generally the other end of said apparatus in the path of travel of the articles, so that said control means may selectively operate said endless chain drive means for rotating said endless chain means in a forward direction for positioning said finger means in contact with the rear of the longitudinally extending row of a predetermined number of articles received in said receiving and positioning means and for moving the group of articles to the other end of said apparatus into engagement with said stop block means and for cooperating therewith to longitudinally compress the group of articles.

4. Apparatus, as set forth in claim 1, in which said means for positioning banding material across the path of travel of the group of articles comprises turntable means rotatably mounted on each longitudinal side of the path of travel of the group of articles from the one end to the other end of said apparatus for carrying respective supply rolls of banding material joined together and extending therefrom across the path of travel of the group of articles and for rotating to unwind the banding material when the group of articles is longitudinally moved into contact with the banding material and moved forwardly thereof for allowing the banding material to position itself around the leading end and sides of the group of articles as the group is moved forwardly thereof to the other end of said apparatus, and brake means operatively connected with said turntable means for stopping rotation of said turntable means when movement of the group of articles has stopped to prevent excessive unwinding of the banding material.

5. Apparatus, as set forth in claim 1, in which said means for moving the banding material around the trailing end of the group of compressed articles comprises pusher plate means movably mounted adjacent and slightly forwardly of the banding material extending across the path of travel of the group of articles for movement into engagement with the banding material extending along one side of the group of articles and across the path of travel of the group of articles for carrying the banding material therewith to position the banding material around the trailing end of the compressed group of articles, and drive means connected with said pusher plate means for reciprocating movement thereof and being operatively connected with said control means for operation thereby.

6. Apparatus, as set forth in claim 1, in which the banding material utilized in said apparatus comprises heat sealable material and said means for sealing the banding material together in encircling relation around the compressed group of articles comprises hot wire means positioned in cooperative relation to said means for positioning the banding material around the trailing end of the group of compressed articles for being contacted by the banding material positioned around the leading end and sides of the compressed group of articles and the banding material positioned around the trailing end of the compressed group of articles for heat sealing the banding material around the compressed group of articles, severing such banding material from the banding material extending across the path of travel of the articles and heat sealing together the thus formed ends of the banding material extending across the path of travel of the articles, and temperature limited heating means connected with said hot wire means and with said control means for selectively heating said hot wire under control of said control means and including means for stopping operation of said heating means when said hot wire reaches a predetermined temperature.

7. Apparatus for compressing and banding a predetermined number of generally flat, compressible articles, such as disposable diapers, comprising, means positioned generally at one of said apparatus for successively receiving the articles and for positioning the articles successively in a longitudinally extending row;

means for moving a group of a predetermined number of the articles from said receiving and positioning means in a generally longitudinal path of travel to generally the other end of said apparatus and for longitudinally compressing the group of articles at the other end of said apparatus;

means for positioning banding material across the path of travel of the group of articles and for allowing the banding material to position itself around the leading end and sides of the group of articles as the group is moved to the other end of said apparatus;

means for moving the banding material around the trailing end of the group of compressed articles positioned at the other end of said apparatus;

means for sealing the banding material together in encircling relation around the compressed group of articles; and control means operatively connected to said article moving and compressing means, said band material moving means and said band material sealing means for sequentially controlling and operating these said means for the compressing and banding operation by said apparatus, said control means comprising a source of electrical energy, an electrical circuit means respectively connected between said source of electrical energy, said article moving and compressing means, said banding material moving means and said banding material sealing means for selectively supplying electrical energy therebetween for sequentially and automatically operating same, means connected in said electric circuit means and with said article compressing and moving means for sensing and counting the articles as they are successively received by said receiving and positioning means for operating said article moving and compressing means after sensing and counting a predetermined number of articles, first limit switch means connected in said electrical circuit means for being actuated upon the positioning of the group of articles at the other end of said apparatus for compression thereof, and timing switch means connected in said electrical circuit means for being initially actuated by said first limit switch means upon its actuation for automatically and sequentially operating said banding material moving means and said banding material sealing means for the banding operation and for preparing said article moving and compressing means, said banding material moving means and said banding material sealing means for the next article compressing and banding operation.

8. Apparatus, as set forth in claim 7, in which said timing switch means comprises a timing motor connected in said electrical circuit means and with said first switch means for being initially actuated thereby, a plurality of timing cams connected with and driven by said timing motor, and cam switches connected in said electrical circuit means and associated with said timing cams for being operated thereby.

9. Apparatus, as set forth in claim 8, in which said control means further includes second limit switch means connected in said electrical circuit means and with said cam operated switches for being actuated by said article moving and compressing means after actuation of said first limit switch means for supplying electrical energy to said cam operated switches.

10. Apparatus, as set forth in claim 7, in which said control means further includes safety limit switch means connected in said electrical circuit means between said article sensing and counting means and said article moving and compressing means and being responsive to positioning of said banding material moving means at a starting position only for allowing operation of said article moving and compressing means by said article sensing and counting means.

11. Apparatus for compressing and banding a predetermined number of generally flat, compressible articles, such as disposable diapers, comprising:

means positioned generally at one end of said apparatus for successively receivng the articles and for positioning the articles successively in a longitudinally extending row;

means for moving a group of a predetermined number of the articles from said receiving and positioning means in a generally longitudinal path of travel to generally the other end of said apparatus and for longitudinally compressing the group of articles at the other end of said apparatus;

means for positioning banding material across the path of travel of the group of articles and for allowing the banding material to position itself around the leading end and sides of the group of articles as the group is moved to the other end of said apparatus;

means for moving the banding material around the trailing end of the group of compressed articles positioned at the other end of said apparatus;

means for sealing the banding material together in encircling relation around the compressed group of articles; and control means operatively connected to said article moving and compressing means, said band material moving means and said band material sealing means for sequentially controlling and operating these said means for the compressing and banding operation by said apparatus, said control means comprising a source of electrical energy, an electrical circuit means respectively connected between said source of electrical energy and said article moving and compressing means, said banding material moving means and said banding material sealing means for selectively supplying electrical energy therebetween for sequentially operating same, automatic operating means including means connected in said electrical circuit means and with said article compressing and moving means for sensing and counting the articles as they are successively received by said receiving and positioning means for operating said article moving and compressing means after sensing and counting a predetermined number of articles, first limit switch means connected in said electrical circuit means for being actuated upon the positioning of the group of articles at the other end of said apparatus for compression thereof, and timing switch means connected in said electrical circuit means for being initially actuated by said first switch means upon its actuation for automatically and sequentially operating said banding material moving means and said banding material sealing means for the banding operation and for preparing said article moving and compressing means, said banding material moving means and said banding material sealing means for the next article compressing and banding operation, manual operating means including separate manually operated switches connected in said electrical circuit means for being opened and closed for manually controlling operation of said article moving and compressing means, said banding material moving means and said banding material sealing means, and manually actuated selecting switch means connected in said electrical circuit for being operated to render said automatic operating means inactive when manual operation of said apparatus is desired and for being operated to activate said automatic operating means when automatic operation of said apparatus is desired.

12. Apparatus, as set forth in claim 11, in which said timing switch means in said automatic operating means comprises a timing motor connected in said electrical circuit means and with said first switch means for being initially actuated thereby, a plurality of timing cams connected with and driven by said timing motor, and cam switches connected in said electrical circuit means and associated with said timing cams for being operated thereby.

13. Apparatus for compressing and banding a predetermined number of generally flat, compressible articles, such as disposable diapers, comprising means positioned generally at one end of said apparatus for successively receiving the articles and for positioning the articles successively in a longitudinally extending row;

means for moving a group of a predetermined number of the articles from said receiving and positioning means in a generally longitudinal path of travel to generally the other end of said apparatus and for longitudinally compressing the group of articles at the other end of said apparatus;

means for positioning banding material across the path of travel of the group of articles and for allowing the banding material to position itself around the leading end and sides of the group of articles as the group is moved to the other end of said apparatus;

means for moving the banding material around the trailing end of the group of compressed articles positioned at the other end of said apparatus;

means for sealing the banding material together in encircling relation around the compressed group of articles;

ejector means for ejecting a compressed and banded group of articles from said apparatus after completion of the compressing and banding operations; and control means including a source of electrical energy, electrical circuit means respectively connected between said source of electrical energry and said article moving and compressing means, said banding material moving means, said banding material sealing means and said ejector means for selectively supplying electrical energy therebetween for sequentially operating same, and separate manually operated switches connected in said electrical circuit means for being opened and closed for manually controlling operation of said article moving and compressing means, said banding material moving means, said banding material sealing means and said ejector means.

14. Apparatus for compressing and banding a predetermined number of generally flat, compressible articles, such as disposable diapers, comprising means positioned generally at one end of said apparatus for successively receiving the articles and for positioning the articles successively in a longitudinally extending row;

means for moving a group of a predetermined number of the articles from said receiving and positioning means in a generally longitudinal path of travel to generally the other end of said apparatus and for longitudinally compressing the group of articles at the other end of said apparatus;

means for positioning banding material across the path of travel of the group of articles and for allowing the banding material to position itself around the leading end and sides of the group of articles as the group is moved to the other end of said apparatus;

means for moving the banding material around the trialing end of the group of compressed articles positioned at the other end of said apparatus;

means for sealing the banding material together in encircling relation around the compressed group of articles;

ejector means for ejecting a compressed and banded group of articles from said apparatus after completion of the compressing and banding operations; and control means including a source of electrical energy, an electrical circuit means respectively connected between said source of electrical energy, said article moving and compressing means, said banding material moving means, said banding material sealing means and said ejector means for sequentially supplying electrical energy therebetween for sequentially and automatically operating same, means connected in said electric circuit means and with said article compressing and moving means for sensing and counting the articles as they are successively received by said receiving and positioning means for operating said article moving and compressing means after sensing and counting a predetermined number of articles, first limit switch means connected in said electrical circuit means for being actuated upon positioning of the group of articles at the other end of said apparatus for compression thereof, and timing switch means connected in said electrical circuit means for being initially actuated by said first switch means upon its actuation for automatically and sequentially operating said banding material moving means, said banding material sealing means and said ejector means for the banding and ejecting operations and for preparing said article moving and compressing means, said banding material moving means, said banding material sealing means and said ejector means for the next article compressing, banding and ejecting operation.

15. Apparatus, as set forth in claim 14, in which said timing switch means comprises a timing motor connected in said electrical circuit means and with said first switch means for being initially actuated thereby, a plurality of timing cams connected with and driven by said timing motor, and cam switches connected in said electrical circuit means and associated with said timing cams for being operated thereby, and said control means further includes second limit switch means connected in said electrical circuit means and with said cam operated switches for being actuated by said article moving and compressing means after actuation of said first limit switch means for supplying electrical energy to said cam operated switches.

16. Apparatus for compressing and banding a predetermined number of generally flat, compressible articles, such as disposable diapers, comprising means comprising an elongate longitudinally extending chamber having a bottom portion defining longitudinally extending slot means therein, side portions and an open top and being dimensioned for successively and snugly receiving the articles at one end thereof oriented in generally vertically and transversely extending positions, for allowing positioning of the articles at the one end thereof in a longitudinally extending row, and for allowing movement of the articles from the one end thereof to the other end thereof for the compressing and banding operation while maintaining the generally vertical and transverse orientation of the articles, said side portions defining an opening therethrough for providing a transversely extending passageway across said chamber;

stop block means positioned at generally the other end of said chamber in the path of travel of the articles for stopping movement of the articles from the one end of said chamber to the other end of said chamber;

means including a longitudinally extending endless chain having the upper flight thereof positioned adjacent and below said slot means in said bottom portion of said chamber and extending from the one end of said chamber to the other end of said chamber, a plurality of compression fingers carried by and extending outwardly from said endless chain in predetermined spaced relationship for extending through said slot means in said bottom portion of said chamber for contact with the articles, and fluid operated drive means connected with said endless chain for being selectively operated to rotate said chain for positioning a respective one of said compression fingers in contact with the rear of the longitudinally extending row of a predetermined number of articles received in said chamber and for moving the group of articles to the other end of said chamber into engagement with said stop block means and for cooperating therewith to longitudinally compress the group of articles;

turntable means rotatably mounted on each longitudinal side of said chamber adjacent said transverse opening therethrough for carrying respective supply rolls of heat sealable banding material being joined together and extending therefrom across the path of the group of articles and being joined together and for rotating to unwind the banding material when the group of articles is longitudinally moved into contact with the banding material and forwardly thereof for allowing the banding material to position itself around the leading end and sides of the group of articles;

means including pusher plate means movably mounted adjacent and slightly forwardly of said turntable means for movement into engagement with the banding material extending along one side of the group of articles and across the path of travel of the group of articles through said transverse opening in said chamber for carrying the banding material therewith to position the banding material around the trailing end of the compressed group of articles, and fluid operated drive means connected with said pusher plate means for selective reciprocating movement thereof;

means including hot wire means positioned in cooperative relation to said pusher plate means for being contacted by the banding material as said pusher plate means moves the banding material around the trailing end of the compressed group of articles for heat sealing the banding material together around the compressed group of articles, severing such banding material from that extending from said turntable means and heat sealing together the thus formed ends of the banding material extending from said turntable means and temperature limited heating means connected with said hot wire means and with said control means for selectively heating said hot wire and for stopping the heating thereof when said hot wire reaches a predetermined temperature; and control means operatively connected to said drive means for said endless chain and compression fingers, said drive means for said banding material pusher plate and said heating means for said hot wire for sequentially controlling and operating same for the compressing and banding operation by said apparatus.

17. Apparatus, as set forth in claim 16, in which said side portions of said chamber means includes means mounting said side portions for transverse adjustment toward and away from each other for allowing adjustment of the dimensions of said chamber for accommodating various sizes of articles.

18. Apparatus, as set forth in claim 16, in which said stop block means includes means mounting said stop block means for longitudinal adjustment relative to said chamber for adjustable cooperation with said compression fingers to compress varying groups of predetermined numbers of articles.

19. Apparatus, as set forth in claim 16, in which said fluid operated drive means for said endless chain comprises double acting piston and cylinder means, rack gear means forming a part of said piston of said piston and cylinder means for reciprocating movement therewith, pinion gear means positioned in meshing engagement with said rack gear means for rotation thereby during reciprocating movement of said rack gear means and having an outwardly extending shaft, sprocket means carried by said pinion gear shaft and positioned in meshing engagement with said chain for driving rotation of said chain during rotation of said pinion gear, one-way clutch means mounted between said pinion gear shaft and said drive sprocket means for rotation of said drive sprocket with said pinion gear and shaft in a forward direction only and for allowing relative rotation of said pinion gear and shaft in the reverse direction without rotation of said sprocket, so that said chain and compression fingers will be moved in a forward direction only while allowing reverse reciprocation of said piston and cylinder means, said rack gear means and said pinion gear shaft means for the positioning thereof in positions for a subsequent article compressing operation, fluid supply means leading to each side of said double acting piston and cylinder means, and solenoid operated valve means positioned in said fluid supply means for being operated by said control means to selectively supply fluid to opposite sides of said piston and cylinder means for selective reciprocation thereof.

20. Apparatus, as set forth in claim 19, in which said drive means for said chain and compression fingers further includes idler sprocket means mounted in meshing engagement with said chain means, and one-way brake means mounted in said idler sprocket means for preventing rearward rotation thereof and thus rearward movement of said chain and compression fingers to hold the compression established by said compression fingers with said stop block means on the group of articles during rearward receiprocating movement of said piston and cylinder means, said rack gear means and said pinion gear means.

21. Apparatus, as set forth in claim 16, in which said turntable means includes brake means operatively connected therewith for stopping rotation of said turntable means when movement of the group of articles has stopped to prevent excessive unwinding of the banding material comprising a respective, elongate arm pivotally mounted intermediate thereof on each of said turntable means and having each end thereof extending outwardly from the outside periphery of said turntable means, friction brake means mounted on one end of said arm for frictionally engaging the outer periphery of said turntable means to brake rotation thereof, roll means mounted on the other end of said arm for receiving the banding material therearound extending from the respective supply roll, and biasing means connected with said arm for biasing said arm in a direction for engagement of said friction brake means with said turntable means, whereby, contact by the moving group of articles with the banding material will cause a force on said roll means to cause pivoting of said arms against the bias of said biasing means to cause disengagement of said friction brake means with said turntable means to allow rotation of said turntable means and unwinding of the banding material from the supply rolls during continued movement of the group of articles.

22. Apparatus, as set forth in claim 16, in which said fluid operated drive means for said banding material pusher plate means includes fluid operated, double acting, piston and cylinder means mounted on said pusher plate means, a source of fluid leading to each side of said piston and cylinder means, and solenoid operated valve means in said fluid supply means and being connected with said control means for selective operation thereby for selectively supplying fluid to respective ends of said piston and cylinder means for reciprocating movement of said pusher plate means.

23. Apparatus, as set forth in claim 16, in which said hot wire means comprises heat stretchable wire which will stretch upon heating thereof to a predetermined temperature, and biasing means biasing said hot wire into a stretched condition so that said wire will stretch when the predetermined temperature therein is reached, and said temperature limited heating means for said hot wire comprises electrically operated heating means connected with said control means for being actuated thereby to heat said hot wire, and switch means connected between said control means and said electrically operated heating means and being responsive to movement of said hot wire to the stretched condition under the bias of said biasing means for stopping operation of said heating means when a predetermined temperature is reached in said hot wire.

24. Apparatus, as set forth in claim 16, in which said control means comprises a source of electrical energy, an electrical circuit means respectively connected between said source of electrical energy, said drive means for said chain and compression fingers, said drive means for said pusher plate means and said heating means for said hot wire means for selectively supplying electrical energy therebetween for sequentially and automatically operating same, means connected in said electrical circuit means and with said drive means for said chain and compression fingers for sensing and counting the articles as they are successively received by said receiving and positioning means for operating said drive means after sensing and counting a predetermined number of articles, first limit switch means connected in said electrical circuit means for being actuated upon the positioning of the group of articles at the other end of said chamber for compression thereof, and timing switch means connected in said electrical circuit means for being initially actuated by said first limit switch means upon its actuation for automatically and sequentially operating said drive means for said banding material pusher plate means and said heating means for said hot wire means for the banding operation and for preparing said drive means for said chain and compression fingers, said pusher plate means and said heating means for said hot wire means for the next article compressing and banding operation.

25. Apparatus, as set forth in claim 24, in which said control means further includes separate manually operated switches connected in said electrical circuit means for being opened and closed for manually controlling operation of said drive means for chain and compression fingers, said drive means for said pusher plate means and said heating means for said hot wire means, and manually actuated selecting switch means connected in said electrical circuit for being operated to render said article sensing and counting means and said timing switch inactive when manual operation of said apparatus is desired by said manual switches and for being operated to activate said sensing and counting means and said timing switch means when automatic operation of said apparatus is desired.

26. Apparatus, as set forth in claim 24, in which said timing switch means comprises a timing motor connected in said electrical circuit means and with said first switch means for being initially actuated thereby, a plurality of timing cams connected with and driven by said timing motor, and cam switches connected in said electrical circuit and associated with said timing cams for being operated thereby, and said control means further includes second limit switch means connected in said electrical circuit means and with said cam operated switches for being actuated by said article moving and compressing means after actuation of said first limit switch means for supplying electrical energy to said cam operated switches.

27. Apparatus, as set forth in claim 16, in which said apparatus further includes ejector means comprising the portion of said bottom portion of said chamber at the other end thereof, means pivotally mounting said portion of bottom portion of said chamber for upward movement to eject a compressed and banded group of articles from said apparatus after completion of the compressing and banding operation, and fluid operated drive means connected with said bottom portion of said chamber at the other end thereof for selective pivotal reciprocating movement thereof for the ejecting operation.

28. In an apparatus for compressing and banding a predetermined number of generally flat, compressible articles, such as disposable diapers; the improvement of means for successively and snugly receiving the articles oriented in generally vertically and transversely extending positions, for allowing positioning of the articles in a longitudinally extending row, for moving a group of a predetermined number of the articles in a forward longitudinal path of travel while maintaining the generally vertical and transverse orientation of the articles, and for compressing the group of articles;

means for banding the compressed group of articles comprising turntable means rotatably mounted on each longitudinal side of the path of travel of the group of articles for carrying respective supply rolls of heat sealable material extending therefrom across the path of travel of the group of articles and being joined together and for rotating to unwind the banding material when the group of articles is longitudinally moved into contact with the banding material and forwardly thereof for allowing the banding material to position itself around the leading end and sides of the group of articles, selectively driven pusher plate means movably mounted adjacent and slightly forwardly of said turntable means for movement into engagement with the banding material extending along one side of the group of articles and across the path of travel of the group of articles for engaging and carrying the banding material therewith to position the banding material around the trailing end of the compressed group of articles, and hot wire means positioned in cooperative relationship to said pusher plate means for being contacted by the banding material as said pusher plate means moves the banding material around the trailing end of the compressed group of articles for heat sealing the banding material around the compressed group of articles, severing such banding material from that extending from said turntable means and heat sealing together the thus formed ends of the banding material extending from said turntable means; and brake means operatively connected therewith for stopping the rotation of said turntable means when movement of the group of articles has stopped to prevent excessive unwinding of the banding material comprising a respective, elongate arm pivotally mounted intermediate thereof on each of said turntable means and having each end thereof extending outwardly from the outside periphery of said turntable means, friction brake means mounted on one end of said arm for frictionally engaging the outer periphery of said turntable means to brake rotation thereof, roll means mounted on the other end of said arm for receiving the banding material therearound extending from the respective supply roll, and biasing means connected with said arm for biasing said arm in a direction for engagement of said friction brake means with said turntable means, whereby contact by the moving group of articles with the banding material will cause a force on said roll means to cause pivoting of said arms against the bias of said biasing means to cause disengagement of said friction brake means with said turntable means to allow the rotation of said turntable means and unwinding of the banding material from the supply rolls during continued movement of the group of articles.

29. Apparatus, as set forth in claim 28, in which said hot wire means comprises heat stretchable wire which will stretch upon heating thereof to a predetermined temperature, biasing means connected to and biasing said hot wire into a stretched condition so that said wire will stretch when a predetermined temperature therein is reached, and temperature limited heating means for said hot wire, and switch means connected with said heating means and being responsive to movement of said hot wire to the stretched condition under the bias of said biasing means for stopping operation of said heating means when a predetermined temperature is reached in said hot wire.

30. Apparatus for compressing and banding a predetermined number of generally flat, compressible articles, such as disposable diapers, comprising:

means positioned generally at one end of said apparatus for successively receiving the articles and for positioning the articles successively in a longitudinally extending row;

means for moving a group of a predetermined number of the articles from said receiving and positioning means in a generally longitudinal path of travel to generally the other end of said apparatus and for longitudinally compressing the group of articles at the other end of said apparatus;

means for positioning banding material across the path of travel of the group of articles and for allowing the banding material to position itself around the leading end and sides of the group of articles as the group is moved to the other end of said apparatus comprising turntable means rotatably mounted on each longitudinal side of the path of travel of the group of articles from the one end to the other end of said apparatus for carrying respective supply rolls of banding material joined together and extending therefrom across the path of travel of the group of articles and for rotating to unwind the banding material when the group of articles is longitudinally moved into contact with the banding material and moved forwardly thereof for allowing the banding material to position itself around the leading end and sides of the group of articles as the group is moved forwardly thereof to the other end of said apparatus, and brake means operatively connected with said turntable means for stopping rotation of said turntable means when movement of the group of articles has stopped to prevent excessive unwinding of the banding material, said brake means comprising a respective, elongate arm pivotally mounted intermediate thereof on each of said turntable means and having each end thereof extending outwardly from the outside periphery of said turntable means, friction brake means mounted on one end of said arm for frictionally engaging the outer periphery of said turntable means to brake rotation thereof, roll means mounted on the other end of said arm for receiving the banding material therearound extending from the respective supply roll, and biasing means connected with said arm for biasing said arm in a direction for engagement of said friction brake means with said turntable means, whereby, contact by the moving group of articles with the banding material will cause a force on said roll means to cause pivoting of said arms against the bias of said biasing means to cause disengagement of said friction brake means with said turntable means to allow rotation of said turntable means and unwinding of the banding material from the supply rolls during continued movement of the group of articles;

means for moving the banding material around the trailing end of the group of compressed articles positioned at the other end of said apparatus;

means for sealing the banding material together in encircling relation around the compressed group of articles; and control means operatively connected to said article moving and compressing means, said band material moving means and said band material sealing means for sequentially controlling and operating these said means for the compressing and banding operation by said apparatus.

* * * * *